US006734613B1

(12) United States Patent
Chang

(10) Patent No.: US 6,734,613 B1
(45) Date of Patent: May 11, 2004

(54) ELECTRON BEAM CONTROLLING DEVICE FOR CRT DISPLAY SYSTEM

(76) Inventor: Kern K. N. Chang, 30 Sagebrush La., Langhorne, PA (US) 19047

( * ) Notice: Subject to any disclaimer, the term of this patent is extended or adjusted under 35 U.S.C. 154(b) by 0 days.

(21) Appl. No.: 10/113,754

(22) Filed: Apr. 1, 2002

Related U.S. Application Data

(60) Provisional application No. 60/282,271, filed on Apr. 6, 2001.

(51) Int. Cl.[7] ..... H01J 24/70

(52) U.S. Cl. ..... 313/421; 313/440; 335/213; 348/828

(58) Field of Search ..... 313/461, 421, 313/440; 335/210, 213; 348/327, 380, 830, 828

(56) References Cited

U.S. PATENT DOCUMENTS 4,197,487 A * 4/1980 Takenaka et al. ..... 315/370
4,490,703 A * 12/1984 Ruth ..... 335/212
4,833,432 A * 5/1989 Ohtsu et al. ..... 335/212
5,550,522 A * 8/1996 Dekkers et al. ..... 335/213

* cited by examiner

*Primary Examiner*—James Clinger
*Assistant Examiner*—Thuy Vinh Tran
(74) *Attorney, Agent, or Firm*—Duane Morris LLP

(57) ABSTRACT

A thin cathode ray tube display system and associated components are disclosed. The system includes a thin cathode ray tube, a body having a substantially flat back element and a front element attached wherein a vacuum is maintained in the body, a neck element attached substantially perpendicular to the flat back element, wherein the neck element contains at least one electron gun for the emission of electrons, a transparent screen attached to the front element, the transparent screen having at least one phosphor layer operable to emit a photon of known wavelength and a substantially flat electron beam controller attached substantially perpendicular to the neck element operable to deflect an electron beam emitted by the at least one electron gun. The flat electron beam controller includes a plurality of coil sets oppositely positioned with regard to the neck to deflect the electron beam horizontally and vertically, wherein each of the coil sets further includes at least one coil arranged on at least one ferrite disk in a substantially trapezoidal shape.

57 Claims, 7 Drawing Sheets

ELECTRON BEAM CONTROLLING DEVICE FOR CRT DISPLAY SYSTEM

PRIORITY FILING

This application claims the benefit of the earlier filing date of U.S. Provisional Patent Application Ser. No. 60/282,271, entitled "Flat Yoke of 145° Deflection Combined With a Thin CRT," filed on Apr. 6, 2001, which is incorporated by reference herein.

FIELD OF THE INVENTION

This application is related to the field of cathode ray tube (CRT) technology and more specifically to thin profile cathode ray tubes (CRTs) and thin electron beam controllers and their use in image display on televisions and computer monitors.

BACKGROUND OF THE INVENTION

Cathode Ray Tube technology has long dominated the television (TV) market and is also found in the computer market as computer monitors. Television picture tubes and computer CRT monitors use well known principles of electron beam deflection and scanning over phosphor covered CRT front screens to produce high quality visual images. Initially, using a single electron gun to generate an electron beam, television images were generated in only a black and white. Later, with the advent of the tri-color electron guns, and appropriate control logic, color images were produced. This has remained the standard for over 30 years.

Even with the advent of larger screen flat panel Liquid Crystal Displays (LCDs) and, recently, plasma displays, CRT technology continues to dominate the consumer television and computer market. While flat panel displays have certain advantages over CRTs, they also exhibit significant disadvantages. A comparison of the characteristics of flat panel displays compared to CRTs is discussed in "Flat-Panel Displays and CRTs" published by Van Nostrand Reinhold Company, New York, 1985. This comparison shows that CRTs continue to exhibit superior picture quality, durability and affordability over other display technologies.

Consumer demand has continually pushed television and CRT technology. First better quality images were demanded, then color images, and currently very large screen television with significant quality improvement, e.g. High Definition TV. However, CRT based televisions are generally limited to a typical size of 36 inches diagonally. Above this size, CRT technology experiences a number of significant problems. One problem is that as the diagonal dimension of the front screen of a CRT or picture tube increases, the weight of the tube increases, as the glass must be made thicker to maintain the necessary vacuum level within the picture tube. Another problem is that as the picture tube size increases, the size and weight of the electron beam controller, or yoke, used to direct the electron beam across the face of the picture tube increases. This increase in size is necessary to achieve a greater deflection of the electron beam to reach the outer edges of the larger picture tube face without undue image or color distortion. Still another problem is the current maximum deflection angle is limited to about one hundred twenty degrees (120°) as there is a need to maintain focus and color convergence of the three-color electron beams at the outer edges of the picture tube. Furthermore, as the size of the conventional cone-shaped magnetic yoke increases, both the mechanical structure and the magnetic field generated reach points of diminished return with regard to power consumption and beam defocusing. Hence, to achieve images greater than those displayed on a conventional 36-inch diagonal television, manufactures have developed front projection and back projection televisions. These systems optically enlarge an image produced by a much smaller CRT television and direct the enlarged image to a front panel. However, projection television does not have the image quality of a CRT of a comparable size.

Hence, there is a need in the industry for large screen CRTs and electron beam controllers that achieve much higher beam deflection and also do not exhibit significant increases in size or weight as the size of the CRT diagonal dimension increases.

SUMMARY OF THE INVENTION

A thin cathode ray tube display system and associated components are disclosed. The system comprises a thin cathode ray tube a body having a substantially flat back element and a front element attached wherein a vacuum is maintained in the body, a neck element attached substantially perpendicular to the flat back element, wherein the neck element contains at least one electron gun for the emission of electrons, a transparent screen attached to the front element, the transparent screen having at least one phosphor layer operable to emit a photon of known wavelength and a substantially flat electron beam controller attached substantially perpendicular to the neck element operable to deflect an electron beam emitted by the at least one electron gun. The flat electron beam controller comprises a plurality of coil sets oppositely positioned with regard to the neck to deflect the electron beam horizontally and vertically, wherein each of the coil sets further comprises at least one coil arranged on at least one ferrite disk in a substantially trapezoidal shape.

DETAILED DESCRIPTION OF THE INVENTION

Figure 1:
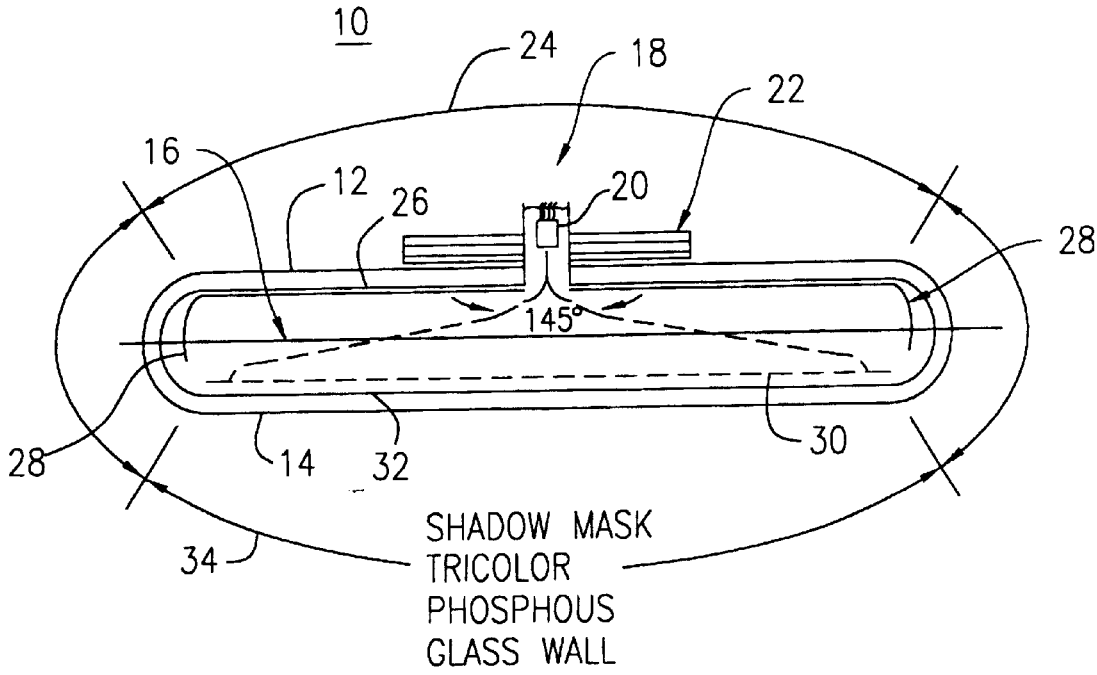
FIG. 1 illustrates cross-sectional view of a thin depth CRT in accordance with the principles of the invention.

FIG. 1 illustrates a cross-sectional view of a thin screen CRT 10 in accordance with the principles of the invention employing conventional TV technology. In this aspect of the invention, CRT 10 comprises a front element 14 and a back or rear element 12 which when attached together using known methods, e.g., Frit seal 16, support a vacuum sufficient to enable electrons to traverse the distance between back element 12 and front element 14. Front element 14 includes a conventional shadow mask 30 and, in color television, a tricolor, i.e., red, green, blue, phosphorous wall on front screen 32 over known region 34 corresponding to a front screen. Back element 12 includes a region 24 containing an inner graphite wall 26 that provides a black screen background. Attached to inner graphite wall 26 are vane elements 28 to shield the glass wall from the scanning electron beam. Protruding from back element 12, substantially perpendicular, is neck 18 that includes electron gun 20, which in the case of color CRT represents three electron beams corresponding to a red, green and blue phosphor on front screen 32. As would be understood, an image is created on screen 32 by selectively illuminating corresponding pixel elements through the scanning of an electron beam emanating from electron gun 20, as it passes through a magnetic field by yoke 22. Surrounding neck 18 is a flat electron beam controller or yoke, 22, as will be more fully described, that causes a deflection of an electron beam emitted from electron gun 20. In one aspect of the invention, yoke 22 is operable to divert an electron beam emanating from electron gun 20 up to to 145 degrees. In one aspect of a thin depth CRT disclosed, back element 12 comprises a substantially flat surface that accommodates flat yoke 22. A flat back element 12 is advantageous as it reduces the depth of CRT 10 and allows the magnetic field of yoke 22 to be brought closer to the front screen 32.

In accordance with conventional TV technology, an electron beam is swept by yoke 22 horizontally, i.e., in rows, and then vertically, i.e., in lines, to create an image on screen 32.

Figure 2:
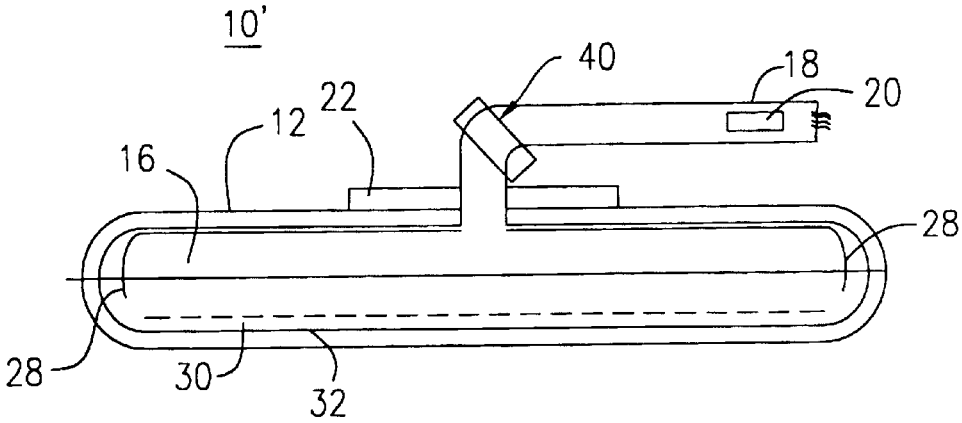
FIG. 2 illustrates a cross-sectional of a thin depth CRT in accordance with a second aspect of the present invention.

FIG. 2 illustrates a second aspect of a thin depth CRT 10' in accordance with the principles of the invention. In this aspect, neck 18 is bent at a transition angle substantially ninety-degrees (90°) preferably. In this case, electrons emanating from electron gun 20 travel parallel to back element 12 and are then directed around the transition angle by bending magnet 40. The transitioned electron beam then passes through yoke 22 substantially perpendicular to back element 12, as previously discussed. This second aspect of the thin CRT is advantageous as it further reduces the depth of CRT 10'.

Figure 3A:
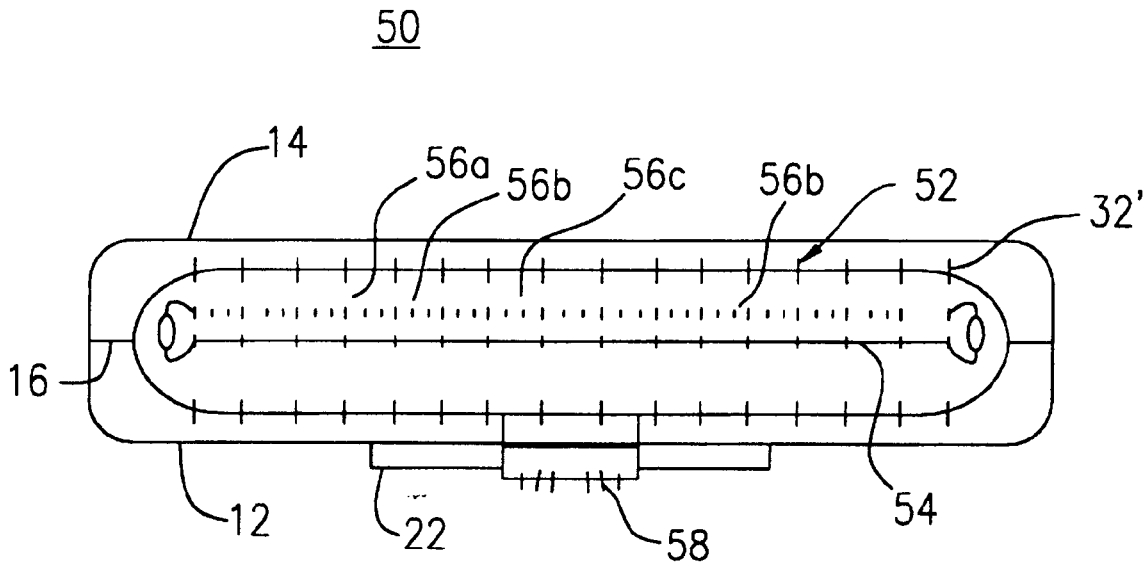
FIG. 3*a* illustrates a cross-sectional view of a thin-depth CRT in accordance with another aspect of the present invention.

FIG. 3*a* illustrates cross-sectional view of a thin-depth CRT 50 in accordance with another aspect of the invention. In this aspect of the invention, back element 12 and front element 14 are joined together by Frit seal 16, for example. Back element 12 comprises the same elements as previously described. However, front element 14 includes a metallic grid structure 52 fused in a thin transparent panel 32'. In this aspect of the invention metallic grid 52 provides structural support for transparent panel 32', which includes phosphor layers and is essentially comparable to screen 32. The use of metallic structure 52 is advantageous as this structure rather than a heavy glass panel provides structural support to withstand the vacuum stresses placed on CRT 50. In this case, the weight of CRT 50 is significantly reduced over that of conventional CRT of a comparable size.

Further included in front element 14 is representative of an "Einzel" lens structure 54 aligned with pixel layer 55 which includes red, green, blue (RGB) pixel control lines, represented as 56*a*, 56*b*, 56*c*, associated with each pixel element in layer 55. Einzel lens 54 has a middle electrode that operates with a zero or negative potential and controls a video signal image arranged on pixel layer 55. The use of a Einzel lens 54 to control the image presented on screen 32' is advantageous as electron gun 58 may be a cold cathode device, e.g., field emission device rather than a hot cathode electron gun used in the current CRT technology. The use of cold cathode electron gun 58 is advantageous as less energy is required to create an electron beam and, consequently, less heat is generated. Furthermore, as the image control is on pixel layer 55 and Einzel lens 54, only a single unmodulated electron bean is required to project an image onto screen 32' rather than a tri-color electron beam modulated for each color.

Although not illustrated, it will be appreciated that metallic grid structure 52 may be used on the thin depth CRTs shown in FIGS. 1 and 2 whether conventional hot-cathode CRT technology or Einzel lens technology is incorporated. Thus, large screen CRTs may be fabricated using existing equipment and technology.

Figure 3C:
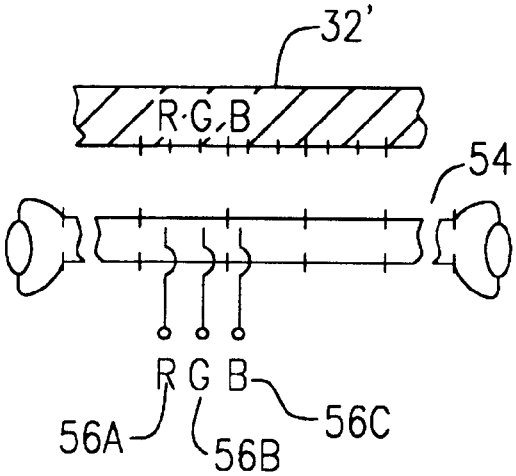
FIG. 3*c* illustrates a pixel control element in the thin-depth CRT shown in FIG. 3*a;*
Figure 3B:
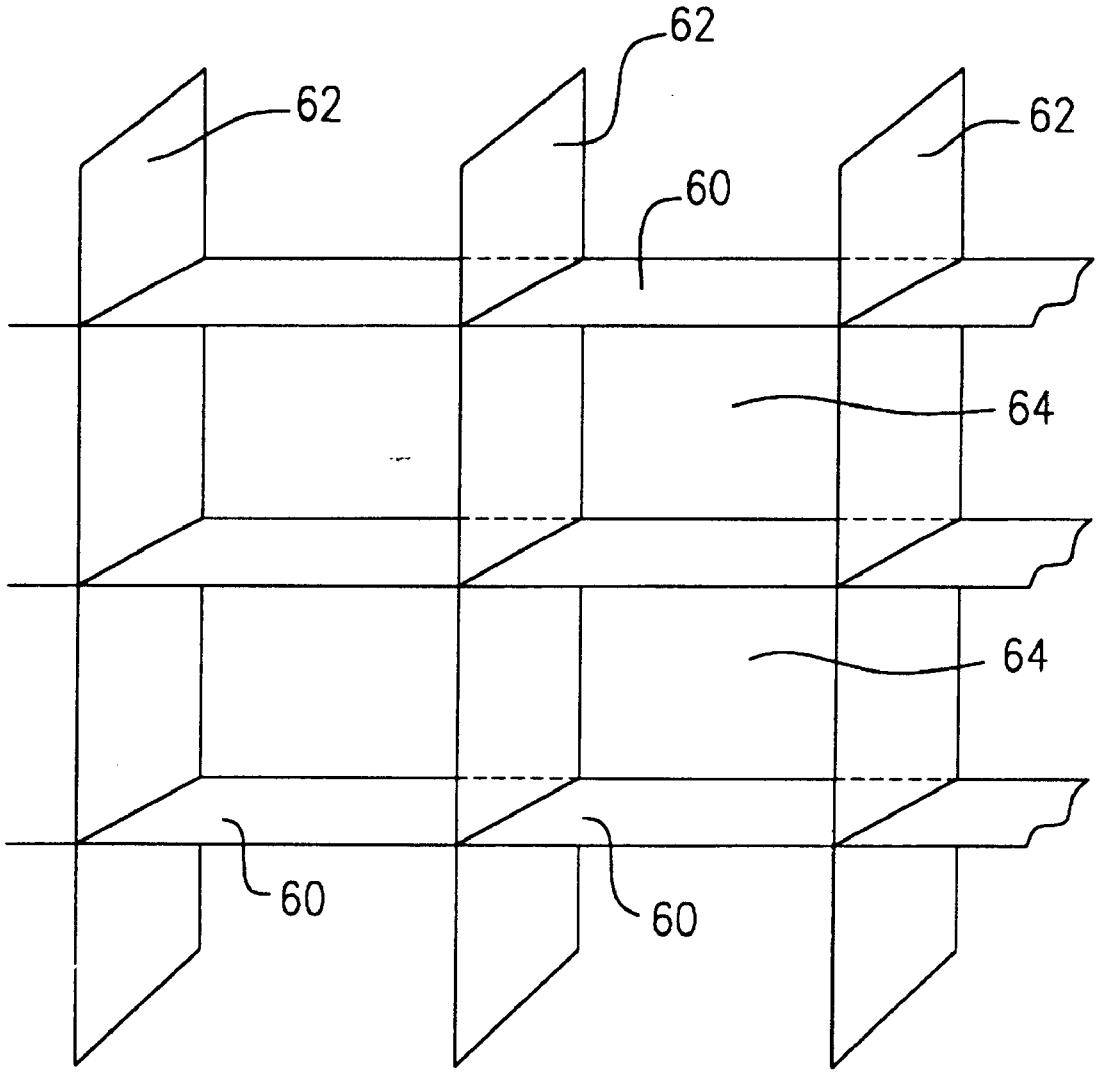
FIG. 3*b* illustrates a perspective view of a support grid in the thin-depth CRT shown in FIG. 3*a;*

FIG. 3*b* illustrates a perspective view of exemplary metallic grid 52 in accordance with the principles of the invention. In this case, metallic grid 52 is represented as an interlocking grid of substantially horizontal rows 60 and vertical 62 columns that form substantially square-like elements 64. As would be appreciated, grid 52 is formed as substantially rectangular-like elements that are matched to the Einzel lens structure 54.

FIG. 3*c* illustrates control of individual pixel element using Einzel lens 54. In this example, an image is applied to individual pixel element through to RGB controls, 56*a*, 56*b*, and 56*c*. Screen 32' is maintained a typically high voltage, in the order of 10 kv, to attract electrons emitted by electron gun 58 (not shown). When a zero voltage is applied to Einzel lens 54, emitted electrons are allowed to pass through Einzel lens 54 and a corresponding pixel element and bombard a corresponding phosphor strip on screen 32'. However, when sufficient negative voltage is applied to Einzel lens 54, emitted electrons are blocked from passing through lens 54 and are no image is presented on screen 32'. Hence, Einzel lens 54 operates as a filter to allow or block an electron beam from bombarding a phosphor layer. Accordingly, an image may be formed on screen 32' by the selective application of color control to individual pixel element controls, selective application of a voltage to Einzel lens 54 and using conventional yoke controlled horizontal and vertical scanning, as previously discussed, to direct electrons to each pixel element.

Figure 4A:
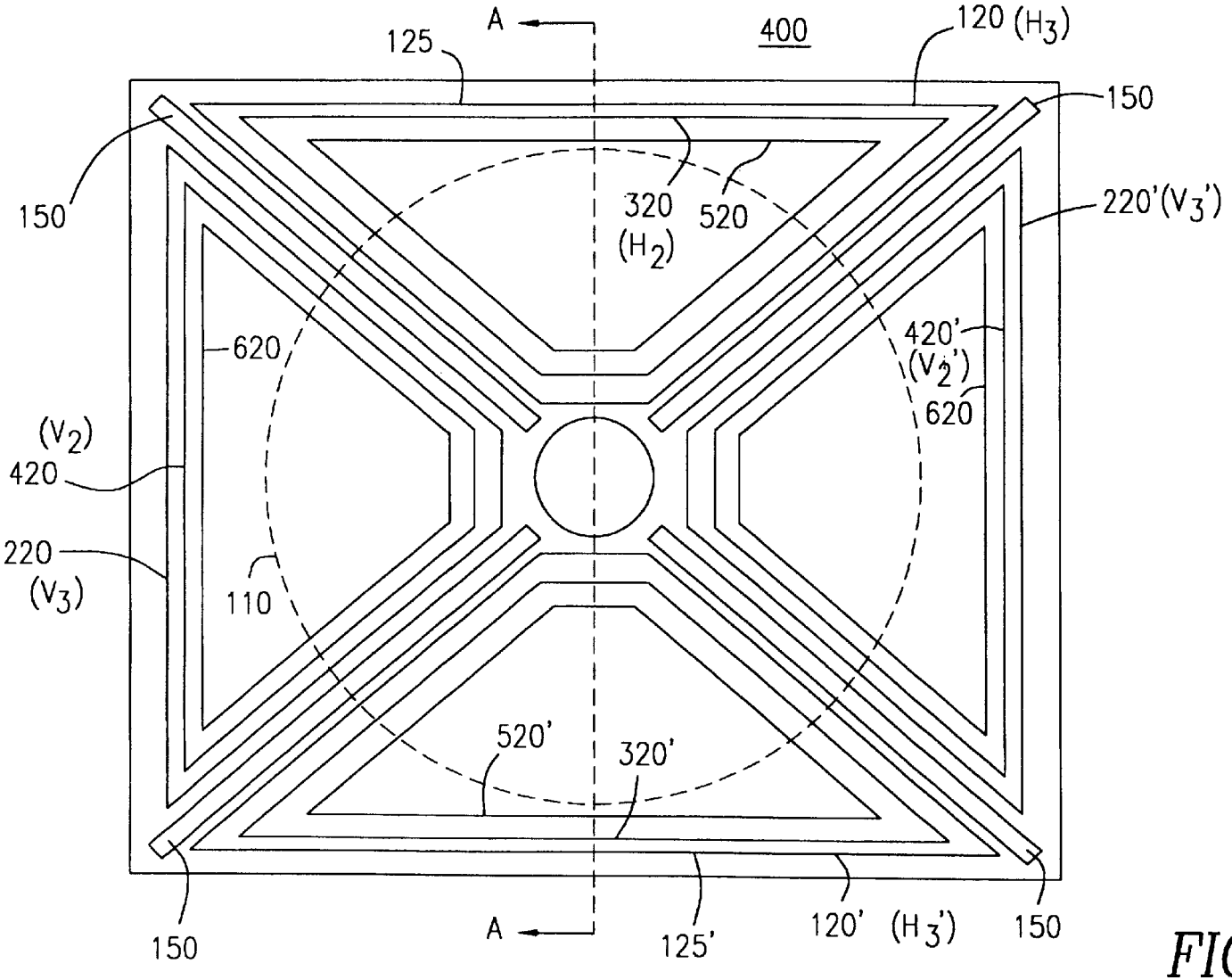
FIG. 4*a* illustrates a frontal view of a planar yoke element in accordance with the principles of the invention.

FIG. 4*a* illustrates an embodiment a planar yoke element 400 in accordance with the principles of the invention. In this embodiment, first coils 120, 120', which are referred to as $H_3$ and $H_3'$, operate as a first cooperative set of coils to divert or deflect an electron beam passing through ring 115 in a horizontal direction and coils 220, 220', which are referred to as $V_3$ and $V_3'$, operate as a first cooperative set of coils to divert or deflect an electron beam passing through ring 115 in a vertical direction. In the preferred embodiment illustrated, coils 120, 120', and 220, 220' are substantially trapezoidal shaped. Trapezoidal shaped coils are advantageous, and preferred, as they provide maximum, interaction of the magnetic field generated by each coil without overlapping the coil elements. The trapezoidal shape also assists in reducing a "pin-cushion" effect at the edge of the CRT screen. Pin-cushion-ing is a common problem in CRT technology that requires special circuitry to overcome. In one aspect, the length of a trapezoidal leg closest to the CRT neck is in the order of the neck radius. It will be appreciated that rectangular shaped coils may be used without altering the scope of the invention.

In the operation of the planar yoke element shown, when a potential is appropriately applied to a respective coil, the current flow in each coil generates a magnetic field that is used to divert the direction of an electron beam passing through circular ring 115. Accordingly, an electron beam is swept horizontally when current 125 is applied to coil 120 and current 125' is applied to coil 120'. As would be appreciated, currents 125 and 125' operate to generate magnetic fields, as is well-known in the art, that extend outwardly from ferrite disk 110 and are returned through ferrite disk 110. Coils 120, 120' operate as a set or group to constructively add and produce a desired level of magnetic flux density across center hole or ring 115. Although not shown, it will be appreciated that a similar application of current through coils 220, 220' produces reinforcing magnetic fields that operate to direct an electron beam passing through circular ring 115 vertically.

In the illustrated embodiment, a material barrier 150 is inserted between adjacent coils 120, 220, 120' and 220', respectively, that is used to reduce the pincushion effect caused by undesirable component magnetic fields. Material barrier 150 is preferably a soft iron type material that shields undersirable magnetic flux.

Also arranged on disk 110, are coils 320, 320', 420, 420', which are contained within and are associated with coils 120, 120', 220, 220', respectively. Coils 320, 320', and 420, 420', similar to coils 120, 120', and 220, 220', are operated as cooperative sets to produce constructively reinforced magnetic fields. These magnetic field further constructively reinforce the magnetic fields associated with their coils, 120, 120' and 220, 220', respectively. Hence, coils 320, 320', which are referred to as $H_2$ and $H_2'$, operate to reinforce the magnetic field associated with coils 120, 120' to direct an electron beam passing through ring 115 in a horizontal direction. Similarly, coils 420, 420', which are referred to as $V_2$ and $V_2'$, operate to reinforce the magnetic field associated with coils 220, 220', respectively, to direct an electron beam passing through ring 115 in a vertical direction.

Use of a second set of coils 320, 320' and 420, 420' is advantageous as it increases the magnetic flux density and deflection sensitivity of an electron beam horizontally and vertically, without incurring an increase in size, weight and power consumption that is necessary to achieve a substantially similar deflection sensitivity of an electron beam using only single coil 120, 120' (or 220, 220'). In this aspect, deflection of an electron beam up to +/−75 degrees may be achieved.

Further arranged on disk 110 are third coil sets 520, 520' and 620,620', which are associated with and contained within coils 120, 320, 120', 320', 220, 420, 220', 420'. In this case, third coil 520, for example, is associated with and contained within coils 120 and 320, while coil 520' is associated with and contained within coils 120' and 320'. Although, coils 520, 520' are similar in shape to associated coils 120, 320 and 120', 320', they are wound in a reverse manner and operate to provide a negative or destructive interference on the deflection of electron beam passing through ring 115. This negative interference on the deflection of an electron beam is advantageous as it provides more precise control of the beam convergence and allows for the incorporation of a planar yoke element in conventional television sets, as will be more fully explained. Hence, third coils 520, 520', for example, may be used to alter electron beam 140 deflection from a nominal +/−75 degrees (i.e., total sweep of 150 degrees) to a conventional +/−60 degrees (total sweep of 120 degrees). Coils 620, 620' similarly operate to provide a negative interference on the deflection of an electron beam in a vertical direction.

Although FIG. 4*a* illustrates a first aspect of the invention, it would be understood by those skilled in the art, that coils 120, 320, 520, for example, may be fabricated as a single coil loop or may operate as independent coils that constructively or destructively interfere with associated magnetic fields. Furthermore, each coil, although operating in cooperative sets, may operate in combination or independent of any other associated coil. For example, coil 320 may be electrically connected in series (i.e., combination) or in parallel (i.e., independent) to associated coil 120, which may be electrically connected in series or in parallel to associated coil 520. Similarly, coil 320' may be connected in series or parallel to associated coil 120', which may be electrically connected in series or in parallel to associated coil 520'. The criteria for selecting electrically connecting of associated coils depends on by realizing a desired level of magnetic flux density across ring 115 to achieve a desired level of electron beam deflection. Determination of current flow to produce desired levels of magnetic flux density is well known in the art.

Furthermore, although associated coils are shown separated by a significant distance, it will be appreciated that the illustrated separation is merely to depict the coils and that the coils may in practice be electrically isolated but in physical contact.

Figure 4B:
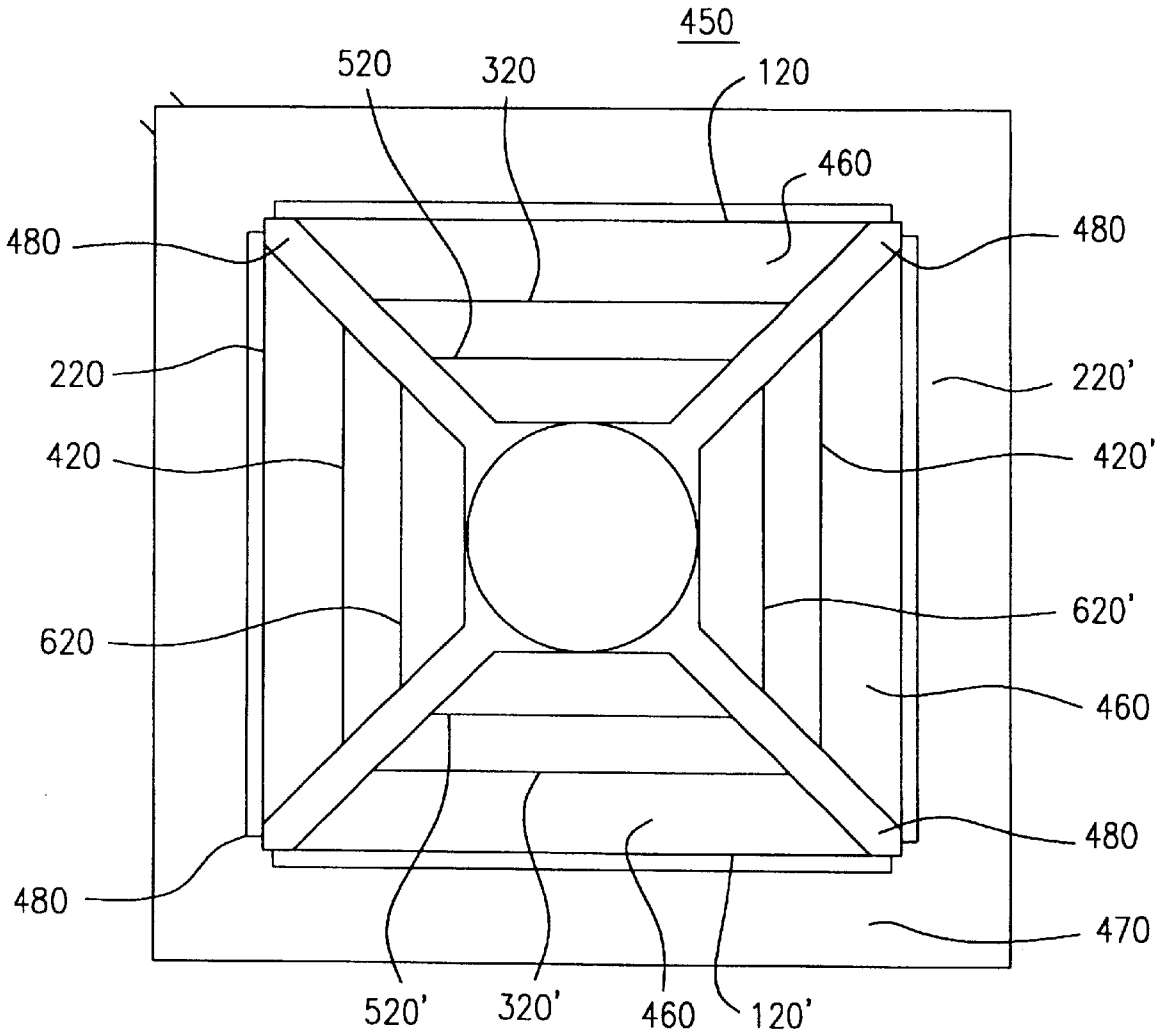
FIG. 4*b* illustrates a frontal view of a planar yoke element in accordance with a second aspect of the invention.

FIG. 4*b* illustrates a second aspect of a planar yoke 450 in accordance with the principles of the invention. In this aspect, ferrite material 460 is placed on an insulating material, e.g., plastic, 470. Horizontal and vertical beam deflection coils, e.g., 120, 320, 530, etc., are arranged on ferrite material 460, as previously discussed. A separation or groove 480 is formed in ferrite material 460. The use of groove 480 is advantageous as it provides a space to conductor wire 225 associated with each coil. Hence, groove 480 provides a means to maintain a substantially flat cross-section of planar yoke 450. Although not illustrated, it will be appreciated that soft material 150 (not shown) may be laid in groove 480. Furthermore, it will be appreciated that ferrite material 460 may be a single material containing grooves 480 or may be plurality of appropriately shaped similar materials separated by a distance, referred to as groove 480.

Figure 5A:
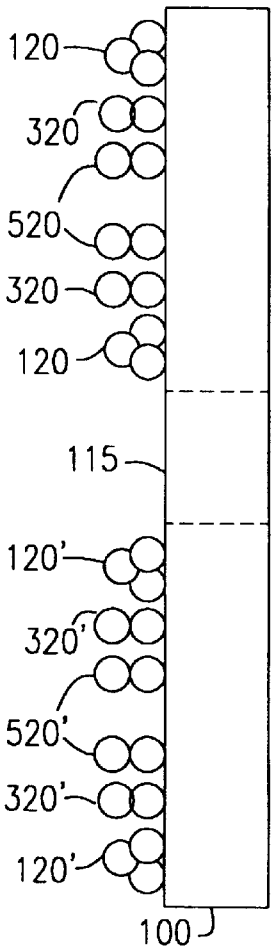
FIG. 5*a* illustrates a cross-sectional view, through section A—A, of the planar yoke element depicted in FIG. 4*a;*

FIG. 5*a* illustrates a cross-sectional view of the embodiment of planar yoke element 400 through section A—A. To more clearly illustrate the position of coils 120, 120', 320, 320', 520, 520' on ferrite material disk 100, the cross-section view of coils 220, 420, and 620 is not shown. In this case, each of the illustrated coils comprises at least one wire conductor 225 mounted substantially in a plane perpendicular to ferrite material disk 100. Wire conductor 225 typically is in the order of 0.15 to 0.4 mm. In a preferred embodiment wire conductor 225 associated with horizontal beam deflection coils 120, 320, 520, for example, is in the order of 0.4 mm and conductor 225 associated with vertical beam deflection coils 220, 420, 620, for example, is in the order of 0.15 mm.

Figure 5B:
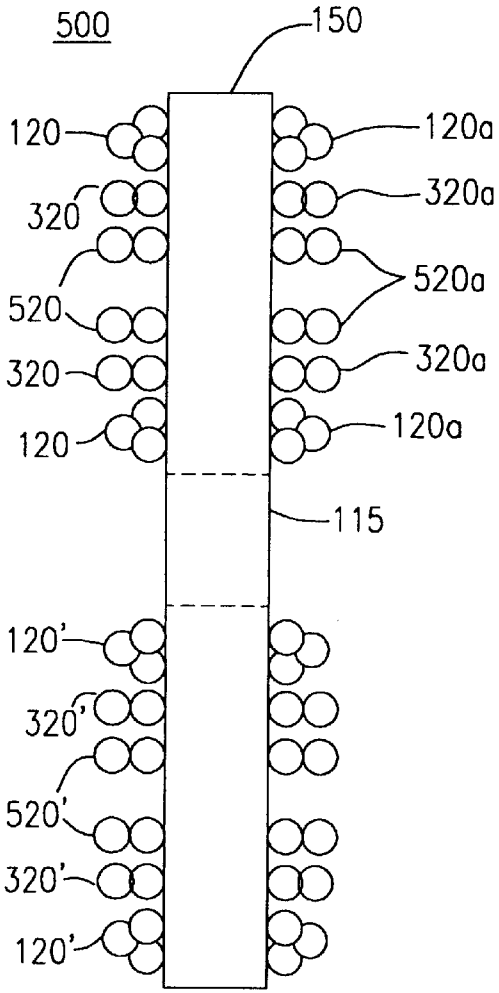
FIG. 5*b* illustrates a cross-sectional view of a planar yoke element in accordance with a second aspect of the invention.

FIG. 5*b* illustrates a planar yoke element 500 in accordance with a second aspect of the invention. In this aspect of the invention, coils are placed on both sides of ferrite disk 100 in a manner as previously discussed. In this configuration the magnetic field across center ring 115 is increased, reinforced or focused by the appropriate application of voltage, and current, to each coil loop to achieve a significant increase in magnetic field across ring 115 without significant increase in power.

Figure 6:
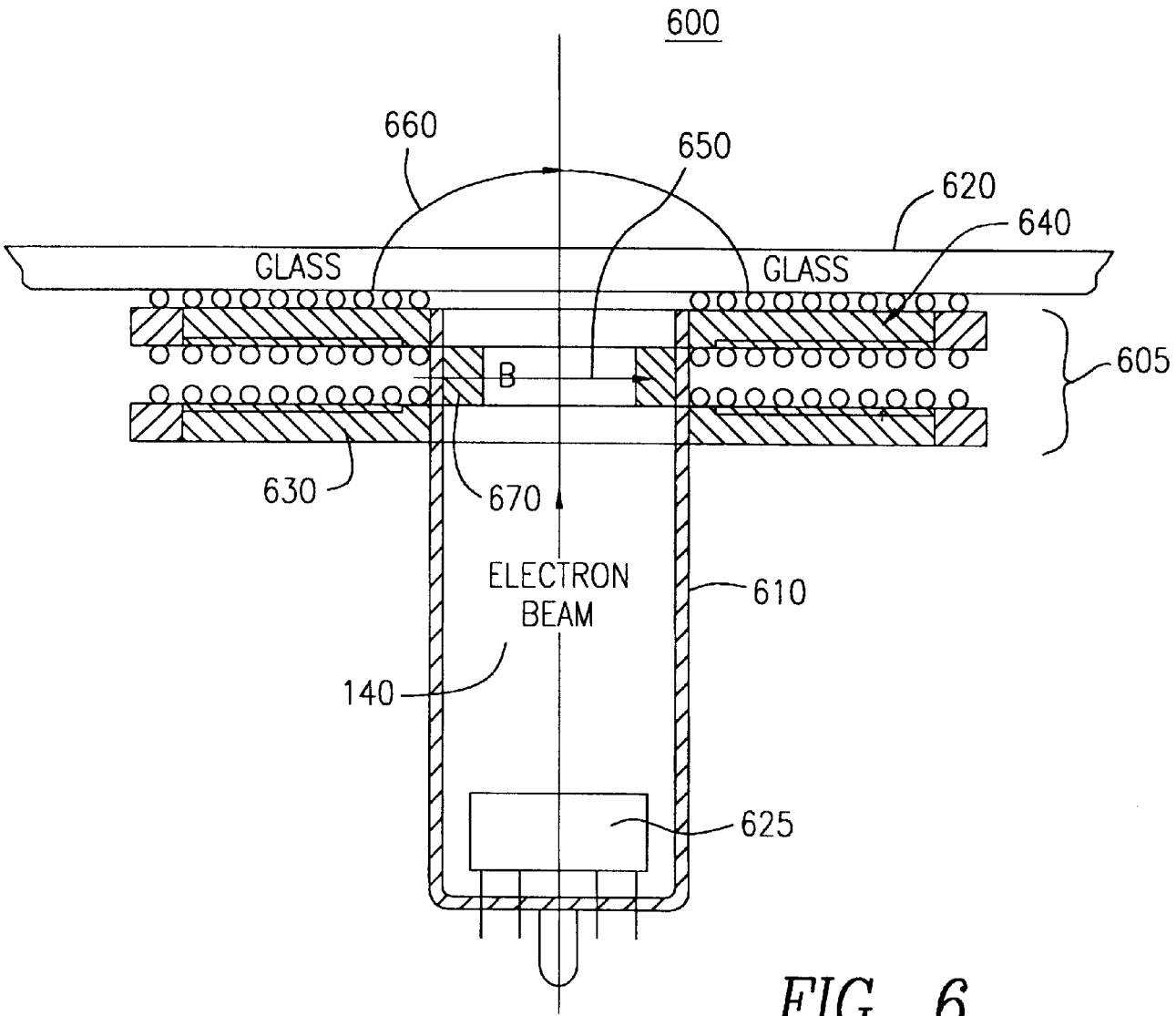
FIG. 6 illustrates a first application of a yoke module in accordance with the principles of the invention.

FIG. 6 illustrates a cross-sectional view 600 of a planar yoke 605 comprised of a single planar yoke element 630, as shown in FIG. 5*a* and a double planar yoke element 640, as shown in FIG. 5*b*. Yoke 605 is placed on a neck 610 of CRT 620, in a conventional manner. Within neck 610 is placed electron gun 625 that emits electron beam 140. Electron gun 625 conventionally outputs a modulated electron beam 140 that is directed toward the screen (not shown) of CRT 620. Appropriate application, with regard to magnitude and polarity of voltage and current to each individual yoke element generates a corresponding level of magnetic field 650 that causes a relatively minor diversion in electron beam 140. This configuration is advantageous as the magnetic flux generated is focused through each disk element and only relatively a low current is necessary in each planar yoke element. The cumulative effect of each minor electron beam deflection results in an overall deflection that may in one aspect achieve a sweep of up to 145°.

Although yoke 605 is shown having mixed planar yoke elements 630, 640, it will be understood from the details disclosed herein that planar yoke 605 may comprise only single sided yoke elements such as shown in FIG. 5*a* or only double sided yoke elements as shown in FIG. 5*b*. It will be appreciated that the outer coils, similar to the third coil in FIG. 4*b* on the outer disk elements of yoke 605 produce a magnetic field 660 not only necessary for limiting electron beam deflection from 145° to 120° but also to assist in the self convergence of the three (i.e., red, green, blue) electron beams of the mask-screen on a conventional color CRT.

As would be known, planar yoke 605 operates in conjunction with a means, such as a step-ferrite slab 670, inside neck 610, a processor or a line scanner controller (not shown) that applies an appropriate voltage to each yoke element to generate varying levels of magnetic field. The varying levels of magnetic field create a deflection in electron beam 140 as it traverses neck 610. Hence, beam 140 enters CRT 620 at an angle that causes an excitement of an appropriate phosphor element on the screen of CRT 620. As would be appreciated, in a color television system, electron gun 625 may comprise a single electron gun or a conventional tri-color electron gun. In this latter case, the level of deflection for associated color beams depends on the color level required at a corresponding pixel element on CRT 620 screen.

While there has been shown, described, and pointed out, fundamental novel features of the present invention as applied to preferred embodiments thereof, it will be understood that various omissions and substitutions and changes in the apparatus described, in the form and details of the devices disclosed, and in their operation, may be made by those skilled in the art without departing from the spirit of the present invention. For example, it is expressly intended that all combinations of those elements which perform substantially the same function in substantially the same way to achieve the same results are within the scope of the invention. Substitutions of elements from one described embodiment to another are also fully intended and contemplated.

What is claimed is:

1. A device for controlling the direction of an electron beam comprising:

a ferrite disk having a first side, a second side and a center hole;

a plurality of first coils arranged on said disk first side wherein said plurality of first coils are non-overlapping; and a second coil isolated from and conformally shaped to an associated one of said plurality of first coils wherein a current flowing through said first coil and associated second coil provides constructive reinforcement of a magnetic field generated by said first coil and associated second coil.

2. The device as recited in claim 1, further comprising:

a soft metal arranged between adjacent ones of said plurality of first coils.

3. The device as recited in claim 1, wherein selected ones of said plurality of first and second coils are arranged into cooperative sets.

4. The device as recited in claim 3, wherein said cooperative sets are selected from said first and second coils diametrically opposed with regard to said center hole.

5. The device as recited in claim 3, wherein said cooperative set is selected from said first and second coils substantially vertically deposed with regard to said center hole.

6. The device as recited in claim 3, wherein said cooperative set is selected from said first and second coils substantially horizontally deposed with regard to said center hole.

7. The device as recited in claim 1, further comprising at least one third coil isolated from and conforming in shape associated with at least one of said plurality of first coils wherein said third coil is reversely wound with regard to said associated first coil.

8. The device as recited in claim 7, wherein said third coil includes at least one conductive element arranged substantially perpendicular to-said ferrite disk.

9. The device as recited in claim 7, wherein said third coil is positioned within an associated first and second coil.

10. The device as recited in claim 7, wherein selected ones of said plurality of said first coils and associated third coils are electrically connected in series.

11. The device as recited in claim 7, wherein selected ones of said plurality of said first coils and said third coils are electrically connected in parallel.

12. The device as recited in claim 1, wherein each of said first and second coils includes at least one conductive element arranged substantially perpendicular to said ferrite disk.

13. The device as recited in claim 1, wherein said second coil is positioned within an associated one of said plurality of said first coils.

14. The device as recited in claim 1, wherein selected ones of said plurality of said first coils and associated second coils are electrically connected in series.

15. The device as recited in claim 11, wherein selected ones of said plurality of said first coils and associated second coils are electrically connected in parallel.

16. The device as recited in claim 1, further comprising:

selected ones of said plurality of said first coils and associated second coils are arranged on said disk second side.

17. The device as recited in claim 16, further comprising:

selected ones of said third coils arranged on said second side, wherein said third coils are reversely wound with regard to said associated first coils.

18. The device as recited in claim 1, wherein said each of said plurality of first coils is substantially trapezoidal.

19. The device as recited in claim 1, further comprising:

a space within said ferrite disk imposed between adjacent ones of said plurality of first coils.

20. The device as recited in claim 1, wherein said ferrite disk further comprises a plurality of shaped ferrite materials.

21. A planar electron beam controller device, comprising:

a plurality of electrically isolated ferrite disks, each having a first side, a second side and a center hole therethrough, said ferrite disks aligned along said center hole, comprising:

a plurality of non-overlapping first coils on at least one of said disk sides; and a second coil isolated from and conformally shaped to an associated one of each of said plurality of non-overlapping first coils.

22. The device as recited in claim 21, further comprising:

a soft metal imposed between adjacent ones of said plurality of first coils.

23. The device as recited in claim 21, wherein selected ones of said first and second coils are arranged into an operative set.

24. The device as recited in claim 23, wherein said operative is selected from said first and second coils diametrically opposed with regard to said center hole.

25. The device as recited in claim 23, wherein said operative set is selected from said coils substantially vertically deposed with regard to said center hole.

26. The device as recited in claim 23, wherein said operative set is selected from said coils substantially horizontally deposed with regard to said center hole.

27. The device as recited in claim 21, further comprising:

at least one third coil isolated from and conforming in shape to an associated first coil wherein said third coil is reversely wound with regard to said associated first coil.

28. The device as recited in claim 27, wherein said third coil includes at least one conductive element arranged substantially perpendicular to said ferrite disk.

29. The device as recited in claim 27, wherein each of said third coils is positioned within a corresponding one of said first coils and said second coils.

30. The device as recited in claim 27, wherein said first coils and associated third coils are electrically connected in series.

31. The device as recited in claim 27, wherein said first coils and associated third coils are electrically connected in parallel.

32. The device as recited in claim 21, wherein each of said first and second coils includes at least one conductive element arranged substantially perpendicular to said ferrite disk.

33. The device as recited in claim 21, wherein each of said second coils is positioned within a corresponding one of said first coils.

34. The device as recited in claim 21, wherein said first coils and associated second coils are electrically connected in series.

35. The device as recited in claim 21, wherein said first coils and associated second coils are electrically connected in parallel.

36. The device as recited in claim 21, wherein each of said plurality of non-overlapping first coils is substantially trapezoidal shaped.

37. The device as recited in claim 21, wherein said second coils are reversely wound with respect to an associated first coil.

38. The device as recited in claim 21, further comprising:

a space imposed between adjacent ones of said plurality of first coils.

39. A beam deflection apparatus for controlling the egress angle of an electron beam comprising:

a plurality of ferrite disks, each having a first side and a second side and a center hole, arranged such that each of said center holes is aligned, each of said ferrite disks comprising:

a plurality of non-overlapping first coils on at least one of said disk sides;

a second coil associated with and physically contained within each of said first coils wherein said second coil is reversely wound with regard to an associated one of said first coils; and a soft metal imposed between adjacent ones of said plurality of non-overlapping first coils.

40. The apparatus as recited in claim 39, further comprising:

means for selectively applying a potential to selected ones of said first and second coils such that coils opposing said center hole are operative as cooperative sets for generating a magnetic field.

41. The apparatus as recited in claim 39, wherein selected one of said first and second coils are serially coupled.

42. The apparatus as recited in claim 39, wherein selected ones of said first and second coils are connected in parallel.

43. The apparatus as recited in claim 39, wherein each of said first and second coils includes at least one conductive element arranged substantially perpendicular to said ferrite disk.

44. The apparatus as recited in claim 39, further comprising:

a third coil associated with and physically contained within a corresponding one of said first coils.

45. The apparatus as recited in claim 39, wherein each of said ferrite disks is arranged on a corresponding insulating material.

46. The apparatus as recited in claim 39, wherein each of said ferrite disks further comprises:

a plurality of shaped ferrite material.

47. The apparatus as recited in claim 46, wherein a space is imposed between adjacent ones of said shaped ferrite materials.

48. The device as recited in claim 39, wherein each of said ferrite disks further comprises:

a plurality of shaped ferrite materials.

49. An electron beam controller comprising:

a plurality of flat disks, each having a substantially central hole, joined along a transverse axis, wherein at least one surface of each of said disks comprises:

at least four non-overlapping regions wherein each of said regions includes:

a coil positioned along a periphery of said region and a coil positioned internal to said periphery coil arranged such that a current flowing in said internal coil is opposite in direction to a current flowing in said periphery coil.

50. The controller as recited in claim 49, further comprising:

a intermediate coil mounted between said periphery coil and said internal coil, wherein a current flowing in said coil is in the same direction as said current flowing in said periphery coil.

51. The controller as recited in claim 50, wherein said periphery coil and said intermediate coil are connected in series.

52. The controller as recited in claim 50, wherein said periphery coil and said intermediate coil are connected in parallel.

53. The controller as recited in claim 49, further comprising:

a soft material contained in a space between said regions.

54. The controller as recited in claim 49, wherein each of said regions is trapezoid shaped.

55. The controller as recited in claim 49, further comprising:

means to apply a potential to each of said coils.

56. The controller as recited in claim 49, wherein said periphery coil and said internal coil are connected in series.

57. The controller as recited in claim 49, wherein said periphery coil and said internal coil are connected in parallel.

* * * * *